United States Patent [19]

Julia et al.

[11] Patent Number: 5,054,080

[45] Date of Patent: Oct. 1, 1991

[54] PNEUMATIC LOUDSPEAKER WITH A CONTINUOUS PRESSURIZED FLUID FLOW

[75] Inventors: Jean Julia, Epinay-Sur-Seine; Ferdinand Pollet, Nanterre; Jean-Francois Foissey, Plaisir, all of France

[73] Assignee: Bertin & CIE, Plaisir Cedex, France

[21] Appl. No.: 325,121

[22] Filed: Mar. 20, 1989

Related U.S. Application Data

[63] Continuation of Ser. No. 790,207, Oct. 22, 1985, abandoned.

[30] Foreign Application Priority Data

Oct. 29, 1984 [FR] France ..... 84 16480

[51] Int. Cl.[5] ..... H04R 25/00

[52] U.S. Cl. ..... 381/165; 381/194

[58] Field of Search ..... 381/165, 153, 154, 156, 381/182, 194; 181/185, 189, 190, 198

[56] References Cited

U.S. PATENT DOCUMENTS

| | | | |
|---|---|---|---|
| 1,766,612 | 6/1930 | De Forest | 381/165 |
| 1,904,156 | 4/1933 | Mallina | 381/165 |
| 2,010,529 | 8/1935 | Van Urk | 381/194 |
| 2,079,694 | 5/1937 | Lovell et al. | 381/165 |
| 2,838,127 | 6/1958 | Jilski et al. | 381/155 |
| 2,923,782 | 2/1960 | Armstrong et al. | 381/182 |
| 3,906,171 | 9/1975 | Braceley | 381/194 |
| 4,118,605 | 10/1978 | Kobayashi | 381/194 |
| 4,498,023 | 2/1985 | Stout | 310/15 |

FOREIGN PATENT DOCUMENTS

| | | | |
|---|---|---|---|
| 1531690 | 7/1968 | France | 381/165 |
| 2442565 | 5/1982 | France | 381/165 |
| 0964709 | 10/1982 | U.S.S.R. | 181/185 |

*Primary Examiner*—Forester W. Isen

*Attorney, Agent, or Firm*—Breiner & Breiner

[57] ABSTRACT

A pneumatic loudspeaker with a continuous pressurized fluid flow modulated by an obstacle forming an integral part of a moving armature with an electromagnetic coil supported by a leakproof elastic membrane. The moving armature comprises a cylindrical support and a winding housed in a flat groove made in the body of the support, the winding and its support forming a rigid integral assembly, the winding being sandwiched between a first layer of glue coating the bottom of the flat groove and a second layer of the glue submerging the turns of the winding and endowing the assembly with a smooth and uniform surface.

4 Claims, 2 Drawing Sheets

PNEUMATIC LOUDSPEAKER WITH A CONTINUOUS PRESSURIZED FLUID FLOW

This is a continuation of application Ser. No. 06/790,207 filed on Oct. 22, 1985, now abandoned.

FIELD OF INVENTION

This invention relates generally to pneumatic loudspeakers of the type with a continuous flow of a pressurized fluid flowing through a pneumatic circuit which extends from a fluid inlet to a fluid outlet, passing via an intermediate annular throat, at right angles to which fluctuations of a throughput which are modulated about a mean value are produced by axial displacements of a throughput-modulating annular member under the control of an electromagnetic transducer driven by a sound signal. "Throughput" as used herein corresponds to fluid flow through the pneumatic circuit.

BACKGROUND OF INVENTION

An apparatus of this type is described in U.S. Pat. No. 1,904,156 of Apr. 18, 1933. In this patent, the throughput-modulating member consists of an aerodynamically profiled toric core suspended by intercrossing metal wires stretched across the stream of driving fluid in which this profiled torus is immersed and which passes right through the electromagnetic command transducer.

A loudspeaker of this kind has a performance which is limited in fidelity and volume of sound. In effect, since there is no such thing as perfect aerodynamic profiling, noise perturbations are unavoidably produced by the particular surface of the modulator torus which is immersed in the flow, and by its suspension wires which pass through it; these perturbations are superimposed on the modulation representing the sound signal to be transmitted and impair the quality of the signal/-noise ratio. Furthermore, the parallelism or coaxiality of the flow to be modulated and of the motion of its modulator member make it necessary to restrict the stream of driving fluid to a very thin lamina if even the smallest axial displacements of the modulator are to result in appreciable changes in stream contraction.

French Patent 78/33,178, published under U.S. Pat. No. 2,442,565, and filed on Nov. 24, 1978 enables these disadvantages to be overcome and offers a loudspeaker of the same type but with a performance which is greatly improved both as regards fidelity and volume of sound. According to this latter patent, the pneumatic circuit, on the one hand, and the electromagnetic transducer, on the other hand, are separated from each other over their whole length by a tranverse wall forming a partition at right angles to the axis of motion of the annular member in the annular throat, which forms an obstacle projecting above the said transverse wall and movable lengthwise across the said annular throat, while the pressurized fluid coming from the fluid inlet of the pneumatic circuit arrives at this annular throat tangentially relative to the transverse wall, that is to say at right angles to the said lengthwise-movable obstacle.

Flow control of a pressurized fluid by the use of a movable obstacle is well known in the field of high sound level sirens and noise generators, and reference may be made on this subject to French Patent 1,531,690, filed on May 25, 1967.

It should be noted, however, that the latter concerns a different technical field, which naturally does not involve the concepts of fidelity and signal/noise ratio, which are specific to loudspeakers, in the case of which:

on the one hand, the frequency operating range must cover the speech spectrum, that is to say the range 300–3,000 Hz;

on the other hand, the signal/noise ratio, which expresses the clarity or the intelligibility of the transmitted signal, must be at least 10 dB over the entire abovementioned operating range.

In French Patent 1,531,690, the movable obstacle has two positions: a projecting position which produces the displacement of an entry jet and a retracted position which produces no displacement. The effect produced by this obstacle is therefore to chop the continuous entry jet into two pulsating output flows, by alternate switching of the said entry jet towards either of two outlet conduits, finally producing a train of waves which are coarse—that is to say unmodulated—and consequently unsuitable for transmitting complex, and especially voice, messages.

In the loudspeaker forming the subject of French Patent 2,442,565, the modulation method employed has a low inertia while ensuring high modulation amplitudes, that is to say it makes it simultaneously possible to preserve the fidelity of vocal quality while ensuring a high retransmission level with a high signal/background noise ratio.

In this case, throughput modulation consists of throughput fluctuations about a mean throughput which is discharged via the same conduit which transmits the sound waves to the outside. This modulation is produced in a single stage in which the pneumatic circuit and the transducer are separated by a wall: on one side of the said wall the pneumatic circuit incorporating a throat extended by a diffuser nozzle, itself extended by an acoustic horn; on the other side of the wall, the transducer whose movable member controls an annular obstacle which projects from this wall, in the plane of the throat of the annular nozzle, the movable obstacle being joined to the said wall by a continuous elastic connection. Furthermore, this wall may incorporate orifices which permit the passage of a flow of fresh air induced by the flow of the driving fluid at the surface of the said wall (thus producing an ejector action) so that efficient cooling of the coil is ensured naturally, permitting the use of hot gases as a driving fluid.

In all these devices of the prior art, difficulties which cause problems may arise in use. Thus, in particular:

since the movable equipment consisting of the winding and its annular support are continuously driven with high-frequency oscillations, these alternating motions run the risk of eventually causing distortions of the support and uncoupling of the winding, causing breakdown of the apparatus;

the elastic connections for supplying the winding electrically have a characteristic frequency which can interfere with that to be produced by the loudspeaker, resulting in a loss of sound purity.

SUMMARY OF INVENTION

This invention relates to improvements to pneumatic loudspeakers, with a view to improving the reliability and behavior of the winding, without involving perturbing natural frequencies associated with electrical connections.

In accordance with a special technical feature of the present invention, extensive stiffening and integration of the movable assembly formed by the winding and its support are produced. To this end, an indentation in the shape of a flattened groove, at the bottom of which a glue such as "Silitrocol" is applied, is made in the body of a support made of a lightweight composite material based on glass fibers or on "Celoron" (asbestos and phenolic resin), the turns of the winding are then wound within the said groove so as to be housed therein without a significant projection above the surface of the support and, finally, the whole is coated with a glue such as "Araldite", endowing the annular assembly with great stiffness, with efficient integration of the winding sandwiched between the two above-mentioned glues, this annular assembly having, moreover, uniform, well-smoothed surfaces, since the unevenness produced by the turns is submerged by the layer of "Araldite".

According to another special technical feature of the present invention, the electrical connection required for the winding-exciting circuit incorporates a slack braid which consequently cannot perturb the operating frequencies.

The following description, accompanied by the attached drawings and given by way of a nonrestrictive example, will make it clear how the invention may be implemented.

DESCRIPTION OF PREFERRED EMBODIMENT WITH REFERENCE TO DRAW

Figure 1:
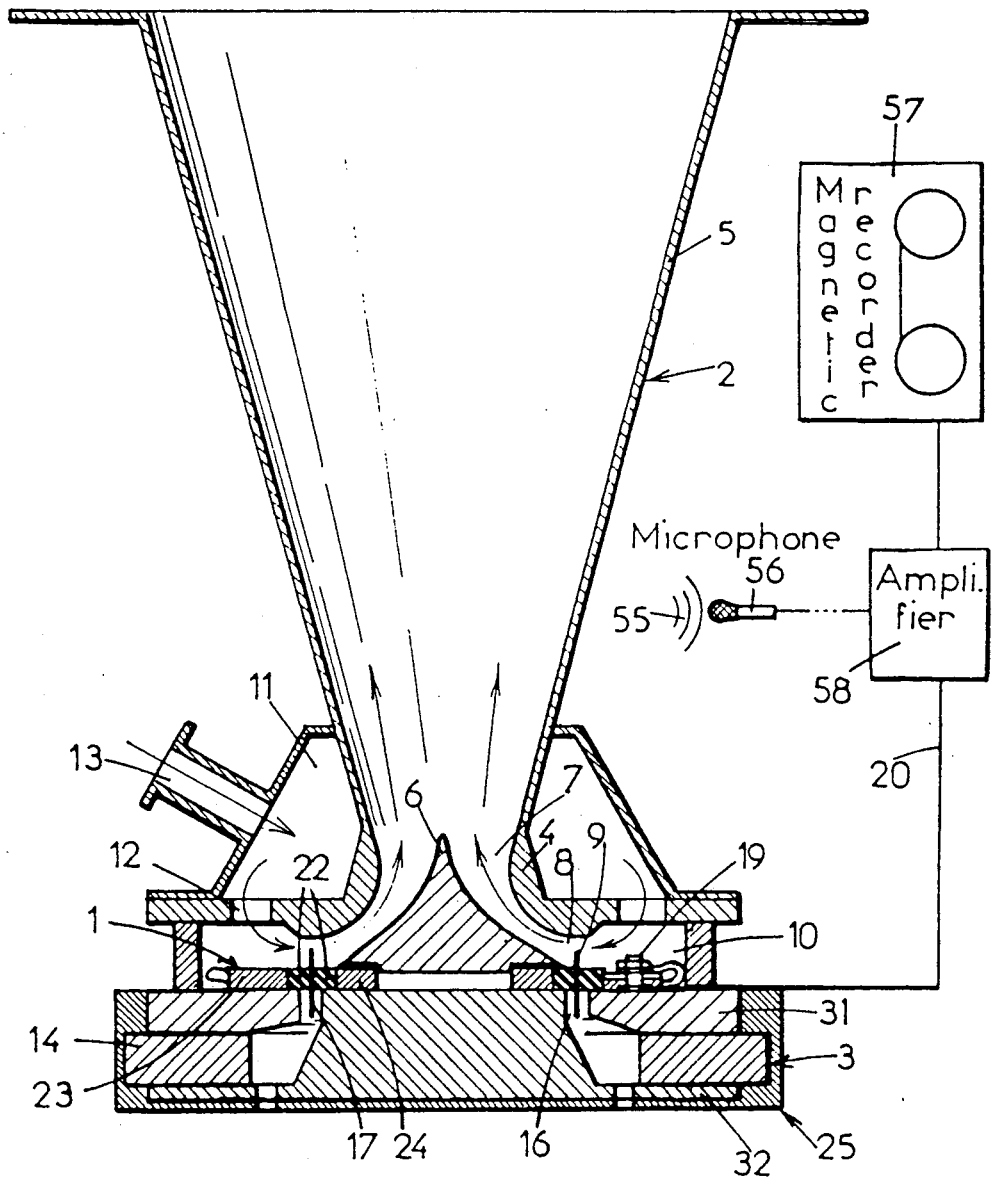
FIG. 1 is a view in axial cross-section of a loudspeaker according to an embodiment of the present invention.

The pneumatic circuit assembly 2, on the one hand, and the transducer 3, on the other hand, can be seen in FIG. 1, on the two sides of a wall 1.

The pneumatic circuit assembly 2 comprises a nozzle 4 extended by an acoustic horn 5, this nozzle 4 defining with a profiled diffuser 6 an annular duct 7 incorporating a throat 8 in the plane of which is arranged an annular obstacle 9 which is a part of the support ring of armature 17. Upstream of this throat 8, a circular manifold 10 is fed uniformly from a volume 11 incorporating orifices 12 distributed regularly at its base, the said volume 11 being fed by a supply line 13. The movable obstacle 9 (see also FIG. 2) is joined to the wall 1 by a continuous elastic connection 22 (made of an elastomer) this wall 1 incorporating an outer crown ring 23 and an inner crown ring 24.

The transducer 3 traditionally consists of a permanent magnet 14 and pole pieces 31, 32 defining an annular gap 16 in which the moving armature 17 of the electromagnetic coil moves lengthwise.

Figure 3:
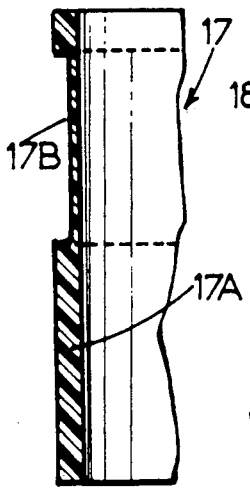
FIG. 3 is a detailed cross-sectional view of the winding support showing the indentation in the shape of a flat groove machined into the cylindrical body of this support, the winding not being shown.
Figure 4:
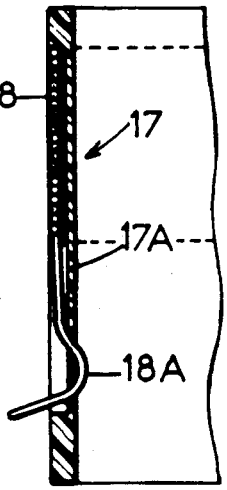
FIGS. 4 and 5 are partial views which show the winding in place, with its electrical connections.
Figure 5:
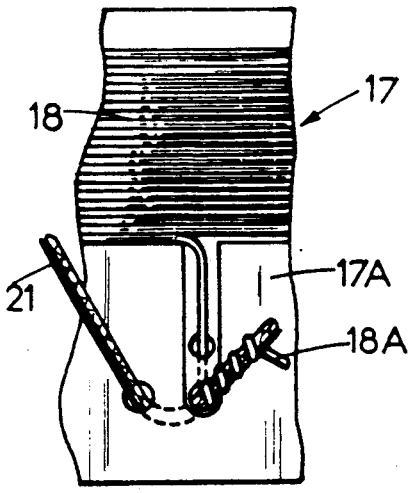

As can be seen more clearly in FIGS. 3, 4 and 5, this moving armature 17 comprises a rigid cylindrical support ring 17A made of glass fibers or of "Celoron", having, on its outer surface, an identation 17B in the shape of a flat groove the bottom of which is coated with glue (for example with "Silitrocol"). Wound in this groove 17B are the turns of the winding 18, without projecting markedly above the outer surface of the support 17A. The whole is then coated externally with a smooth layer of flue (for example "Araldite") in which the said turns are submerged and which forms a support winding assembly which is both integral and rigid.

Figure 2:
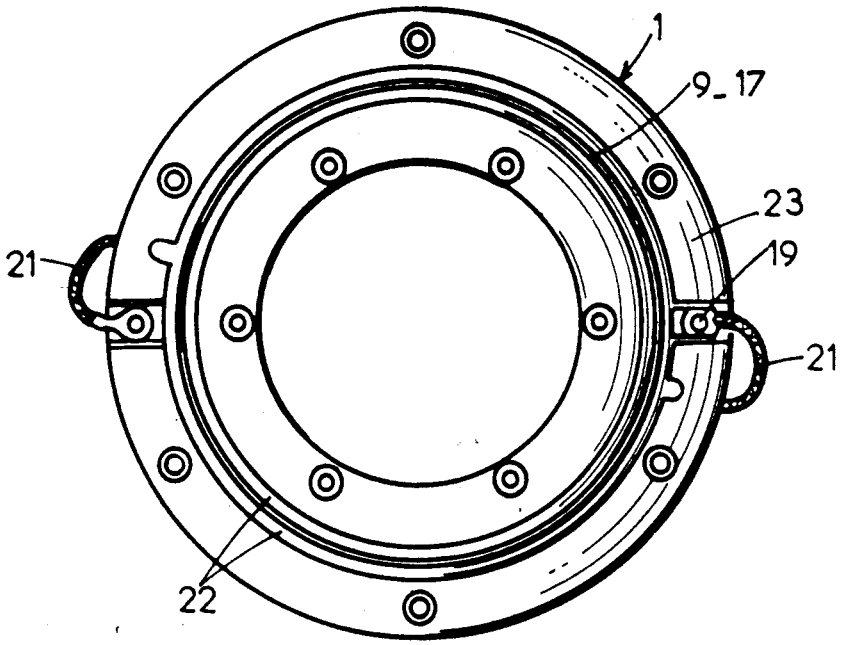
FIG. 2 is a plan view, partly enlarged.

The winding 18 terminates in a twisted end 18A connected to a supply terminal 19 of an electrical signal by braided conductors 21 (see also FIG. 2).

The said electrical signal, produced by the conversion of a voice input signal 55 via a microphone 56 or a magnetic recorder 57, and its amplification in the amplifier 58, is conveyed to the feed terminals 19 by a cable 20 (See FIG. 1).

The transducer assembly can be housed in a cylindrical casing 25. As apparent, pneumatic circuit 2 is separated from the electromagnetic transducer 3 over their respective lengths by continuous annular elastic membrane 22 through which cylindrical support 17 passes.

The pneumatic loudspeaker just described operates as follows:

Under the effect of the electric signal passing through the winding 18 of the moving armature 17, the movable obstacle 9 moves in the plane of the throat 8 and thereby modifies the passage cross-section of the power flow around a mean throughput determined by the rest position, in the absence of a signal, of obstacle 9 in the plane of the throat 8. The amplitude of the signal to be transmitted is thus modulated by these throughput fluctuations.

It is obvious that the embodiment described is merely an example, and that it could be modified, especially by substituting technical equivalents, without departing thereby from the scope of the invention.

We claim:

1. A pneumatic loudspeaker having a pneumatic circuit in which a continuous pressurized fluid flows through an intermediate annular throat, said fluid flow being modulated by axial displacements of a fluid flow modulating annular obstacle under the control of an electromagnetic transducer driven by a sound signal; said electromagnetic transducer comprising a movable armature having thereon a movable winding between a narrow annular gap of a large diameter formed by pole pieces of a permanent magnet, said movable winding being located at one end of an annular wall of a cylindrical support with the other end thereof constituting said fluid flow modulating annular obstacle, said pneumatic circuit being separated from the electromagnetic transducer by a continuous annular elastic membrane through which the cylindrical support passes in a leakproof manner; said annular wall of said cylindrical support being composed of a lightweight composite material, with the end of said support which holds the movable winding being of a low height comparatively to its diameter and the support further being provided with a flat annular indentation formed in the thin outer wall to form a winding housing, said winding being substantially contained in said indentation and being sandwiched between a first layer of glue coating the bottom of said indentation and a second layer of glue embedding turns of the winding so as to form a rigid integral assembly with a smooth and uniform surface flush with an outermost surface of said one end of said annular wall.

2. A pneumatic loudspeaker as claimed in claim 1, wherein the connection of the winding to its external excitation circuit incorporates the insertion of a slack electric braid ending in a terminal.

3. A pneumatic loudspeaker as claimed in claim 1, wherein the continuous annular elastic membrane is mounted interposed between an outer crown ring, and an inner crown ring, the assembly of these three components forming the transverse wall which separates the pneumatic circuit from the electromagnetic transducer.

4. A pneumatic loudspeaker as claimed in claim 3, wherein the continuous elastic membrane is produced by two ring seals made of an elastomer and arranged in the same transverse plane but on opposite sides of the lengthwise-movable armature.

* * * * *